US006478619B1

(12) United States Patent
Wiechmann

(10) Patent No.: US 6,478,619 B1
(45) Date of Patent: Nov. 12, 2002

(54) ELECTRICAL CONNECTOR

(76) Inventor: Wayne Wiechmann, P.O. Box 1809, Tulare, CA (US) 93725

( * ) Notice: Subject to any disclaimer, the term of this patent is extended or adjusted under 35 U.S.C. 154(b) by 0 days.

(21) Appl. No.: 09/949,341

(22) Filed: Sep. 10, 2001

(51) Int. Cl.[7] ..... H01R 13/40
(52) U.S. Cl. ..... 439/587
(58) Field of Search ..... 439/587, 595, 439/274, 684, 686, 318, 321, 313, 557, 281, 275, 286, 604, 280, 932, 936, 38–40

(56) References Cited

U.S. PATENT DOCUMENTS 2,660,679 A 11/1953 Hunt
3,335,389 A 8/1967 Reichardt
4,664,461 A 5/1987 Schubert et al.
5,873,750 A 2/1999 Cairns et al.
6,010,348 A * 1/2000 Alden ..... 439/274
6,183,264 B1 * 2/2001 Harsanyi ..... 439/38

* cited by examiner

*Primary Examiner*—Renee Luebke
*Assistant Examiner*—Phuongchi Nguyen
(74) *Attorney, Agent, or Firm*—Richard A. Ryan

(57) ABSTRACT

An electrical connector for electrically connecting two objects together, such as a vehicle and a trailer, utilizing receptacle and plug members connected to wire assemblies. The receptacle member has a housing with a bore and a first contact assembly located in the bore. The first contact assembly base has channels that slidably receive pins. Springs bias the pins to extend past the base and into the bore. The plug member has a housing with an insert portion and a second contact assembly located in the insert portion. The second contact assembly base has channels that hold pins flush with the forward end of the base. The insert portion is received in the receptacle bore so the pins abut. The spring biased pins of the receptacle maintain contact when the connector is subject to vibration. Sealing mechanisms on the insert portion seal against the inside of the receptacle bore.

32 Claims, 5 Drawing Sheets

ELECTRICAL CONNECTOR

BACKGROUND OF THE INVENTION

A. Field of the Invention

The field of the present invention relates generally to electrical connectors for electrically connecting two objects together. More specifically, this invention relates to pin/socket electrical connectors that sealably connect to keep out water, dust and other contaminates and which are able to maintain the electrical connection when exposed to vibrations and other adverse conditions. Even more specifically, this invention relates to electrical connectors for connecting the electrical components of a towed vehicle to the electrical system of a towing vehicle.

B. Background

Many devices are electrically joined together or joined to an electrical system through the use of an electrical connector. Most of these are of the plug and socket type. The basic purpose of the typical plug/socket connector is to provide a secure, yet easily removable, connection. For instance, virtually all televisions, computers, home appliances and other such devices electrically connect to a home or business electrical system by utilizing a plug that connects the wires of the device to an outlet (i.e., socket) that is connected to the electrical system. Generally, these plug connectors are designed and configured to connect to any standard outlet so that electricity can be delivered to the electrical components of the device no matter where it is used. Although the electrical components of the devices vary substantially from one device to another, the use of the standard plug and outlet configuration allows all devices to be utilized in the same electrical system. Some devices, for instance clothes dryers and many industrial devices, require a different plug arrangement that is configured to compensate for the special needs (i.e., voltage) of the device relative to standard devices.

Generally, the typical plug/socket connector commonly used in homes and business are not exposed to water and other fluids, excessive dust and other contaminants or to vibration forces of any measurable amount. This is not the case, however, for electrical connectors utilized for connecting the electrical components of a towed vehicle with the electrical system of a towing vehicle. A number of different vehicles can be towed. For instance, trailers, including trailers used for hauling boats, cars, motorcycles, snow or water craft are commonly towed by commercial and non-commercial vehicles. In addition, trailers are used to transport goods, livestock and other materials for commercial purposes. Naturally, because they are used outside, both the towing vehicle and towed vehicle are exposed to the elements, including rain, snow, freezing temperatures and the like. In addition, both vehicles are often exposed to blowing dust and other materials. As the towed and towing vehicle move together down the road, they are also exposed to vibration forces from the motion of the vehicle wheels against the road, whether nominally smooth or not. On occasion, the vibration forces can be somewhat significant, such as when passing over a large pothole.

The towing vehicle, which is usually a car or truck, has an electrical system that connects the forward lights, tail lights, brake lights, turning signals and other electrical components to the vehicle's electrical supply (i.e., battery, generator, etc.). Generally, the towed vehicle does not have its own electrical supply and, therefore, must electrically connect to the towing vehicle to supply electrical power to the towed vehicle's electrical components (including brake, tail, turning and other lights). To avoid having to hand wire the wiring system of the towed vehicle to each towing vehicle, virtually all modern towing arrangements utilize an electrical connector to electrically connect the two vehicles. For uniformity purposes, many different towing systems utilize the same or similar connectors. In general, the electrical connector between the towing vehicle and the towed vehicle connects the electric components of the towed vehicle with the towing vehicle's electrical system. In this way, when the operator of the towing vehicle turns on the lights, steps on the brakes or turns the signal light on, the corresponding light(s) in the towed vehicle also operate.

Several patents have issued for electrical connectors which are utilized for electrically connecting a towed vehicle to a towing vehicle. One such patent is U.S. Pat. No. 2,660,679 to Hunt. This patent discloses a connector for interchangeably connecting the wiring systems of tractors and trailers that comprises a plug member and a cap member having a number of jacks that fit into sockets in the plug member. The plug and cap are locked together with a pin and slot mechanism to enclose the jack/socket connections. Another patent is U.S. Pat. No. 3,059,073 to French, which discloses an electrical connector having a cylinder with a number of pairs of contacts spaced about the cylinder and a plunger having metal male elements thereon. A spring is located between the plunger and the closed end of the cylinder to bias the plunger toward the open end of the cylinder. The trailer connector, having conductive sockets therein, is inserted into the cylinder to make the electrical connection. A latch element holds the trailer connector in the cylinder. Yet another patent, U.S. Pat. No. 3,335,389 to Reichardt, discloses a tail light adapter bulb that has a separate socket and bulb for providing external electrical connection between vehicles and trailers. The tail light adapter has pig-tail leads that have female connectors that connect to the male connectors of the trailer lighting system. The electrical hook-up between a towing vehicle and trailer can be done by removing the pre-existing tail light bulb and installing the adapter bulb assembly in its place.

Yet another patent, U.S. Pat. No. 4,664,461 to Schubert et al., discloses a molded connector that includes a number of cavities and passages in a single housing. Conductor wires are inserted into the connector through the passageways and spring fingers open to engage shoulders so as to prevent rearward movement of the wires. Forward movement of the wires is prevented by shoulders that lock the conductor wires in place. Sealing members and corresponding annular grooves to lock the sealing members into position are used to prevent the entry of moisture, dust, etc. into the connector. U.S. Pat. No. 5,873,750 to Cairns et al. discloses a connector assembly having a plug body and a socket body for use with the pin/socket junction elements of fiber-optical and electrical connectors in underwater conditions. The plug body mates with the socket body by a coupling sleeve that engages the threaded end portion of the plug body. The fiber-optic or electrical leads on the plug side terminate at a probe at the front of the plug body. The fiber-optic or electrical leads on the socket body side terminate in a ferrule having a sleeve that projects forwardly therefrom to form a socket for receiving a respective probe from the plug body. When the plug and socket are joined together, a spring biases the end faces of each probe against the end face of the corresponding socket so that the fiber/electrical ends are in contact for optical/electrical connection.

None of the aforementioned devices solves the problems associated with secure electrical connections in the manner of the present invention. For towing and other purposes it is important to have electrical connectors that sealably connect so as to keep out water, dust and other contaminants to avoid shorting or otherwise interrupting the electrical connection between the two vehicles. In addition, the electrical connector needs to take into account the vibration forces that the two vehicles will be subject to so as to avoid unintentional disconnecting of the electrical connector. Current pin and socket have a number of problems when used in the above-described uses. For instance, the standard pin and socket connector relies on a tight "interference" fit that holds the pin in the socket. As a result of vibration and other forces, the socket hole gets bigger and the pin smaller, resulting in a loss of the necessary tight fit. Also, over time any seals used to keep out water and other contaminants tend to become worn from friction and damaged from contact during the installation and removal of the pin from the socket. In addition, most pin/socket connectors are subject to considerable damage from sudden pulling on the wires leading to the connectors, such as when the pin is in the socket when the pulling vehicle moves away from the pulled vehicle. Another problem for most pin/socket connectors is that they tend to have an exposed arc between the pin and the socket as the pin becomes displaced from the socket, which has the potential to create an explosion if the connector is used around explosive gasses.

Although the various electrical connector devices currently available have the ability to electrically connect two objects together and address some of the problems associated with obtaining a secure connection between a towing vehicle and a towed vehicle, they have the aforementioned disadvantages and limitations that have prevented wide acceptance. What is needed, is an easy to use and effective electrical connector that can securely connect multiple wire systems between a towing vehicle and a towed vehicle so as to prevent the entry of water, dust and other contaminants and maintain the connection when subject to vibration forces.

SUMMARY OF THE INVENTION

The electrical connector of the present invention solves the problems identified above. That is to say, the present invention discloses a new and useful electrical connector that effectively connects and maintains the connection between a towing vehicle and a towed vehicle. The electrical connector of the present invention is adaptable to new and existing trailers, is easy for the towing vehicle operator to use and provides a secure vehicle-to-vehicle electrical connection. The electrical connector of the present invention prevents water, dust and other contaminants from entering the connector and interfering with the electrical connection. In addition, the connector is configured to be able to withstand vibration forces.

The preferred embodiment of the electrical connector of the present invention comprises a receptacle member and a releasably mateable plug member that join together to form the electrical connector for electrically connecting two objects together. The receptacle member has housing with a first end and a second end. At the second end of the receptacle housing is a bore having at least one inner diameter. A first wire assembly, having a first set of wires comprised of one or more wires, is connected to the first end of the housing. of the receptacle. A first contact assembly is disposed in the receptacle bore. In the preferred embodiment, the first contact assembly has a base with a forward end, a rearward end and one or more channels therein. Each of the channels are configured to slidably receive a first pin. Each of the first pins are electrically connected to one of the wires in the first set of wires. A spring is disposed between each of the first pins and the rearward end of the base so as to bias the first pins to extend beyond the forward end of the base. In the preferred embodiment, a retaining plate is utilized at the rearward end of the receptacle base to contain the pin and spring in the base. The plug member has a housing with a first end and a second end. A plug insert portion is located at the second end of the plug member and is configured to be releasably mateable in the bore of the receptacle member. A second wire assembly, having a second set of wires comprising one or more wires, is connected to the first end of the housing of the plug member. A second contact assembly is disposed in the insert portion at the first end of the plug member. The second contact assembly has a base with a forward end, a rearward end and one or more channels therein. Each of the channels are configured to hold a second pin therein. The second pins are configured to abut the first pins in the receptacle member when the insert portion is inserted into the bore. Each of the second pins are electrically connected to one of the wires in the second set of wires.

Preferably, the bore of the receptacle unit has a first inner diameter for receiving the first contact assembly and a second and third inner diameters for receiving the plug insert portion. On the insert portion of the plug member are positioned at least two sealing mechanisms, one of the sealing mechanisms configured to seal the insert portion in the second inner diameter of the bore of the receptacle member and one of the sealing mechanisms configured to seal the insert portion in the third inner diameter of the bore. The preferred embodiment of the present invention also has a first end cap assembly at the first end of the housing of the receptacle member and a second end cap assembly at the first end of the housing of the plug member. The first end cap assembly is configured to seal the first end of the receptacle housing and tightly engage the first wire assembly. The second end cap assembly is configured to seal the first end of the plug housing and tightly engage the second wire assembly. In an alternative embodiment, one or more magnets can be used on the first contact assembly and/or on the second contact assembly to improve the contact and lessen the need for a tight fit, thereby making it easier to pull the receptacle and plug members apart.

The electrical connector of the present invention solves the problems with prior art connectors that rely on only the tight interference fit to maintain the connection. In addition, the present electrical connector effectively seals the connector from intrusion from water, moisture, dust and other contaminants. Unlike prior art connectors, if the plug member is pulled out of the receptacle member, it will not damage the connector nor reduce its ability to connect. In addition, the present connector is explosion proof in that it contains any arcing between the pins inside the sealed receptacle housing.

Accordingly, the primary objective of the present invention is to overcome the disadvantages associated with presently available electrical connectors and to provide an electrical connector that is easy to use and provides a secure electrical connection that prevents the entry of water, dust and other contaminants and maintains that connection when subject to vibration forces.

It is also an object of the present invention to provide an electrical connector that is adaptable for use to electrically connect a towing vehicle to a towed vehicle.

It is also an object of the present invention to provide an electrical connector having spring-biased pins in a receptacle that can better provide contact with the pins in the plug.

It is also an object of the present invention to provide an electrical connector having multiple seals that are able to maintain the seal as the plug member becomes disengaged from the receptacle member so as to reduce the likelihood of an explosion.

It is also an object of the present invention to provide an electrical connector having a first pin assembly in a receptacle member connected to a first wire assembly and a second pin assembly in a plug member connected to a second wire assembly, wherein the first pin assembly are spring biased.

BRIEF DESCRIPTION OF THE DRAWINGS

In the drawings which illustrate the best modes presently contemplated for carrying out the present invention.

DETAILED DESCRIPTION OF THE PREFERRED EMBODIMENTS

Figure 1:
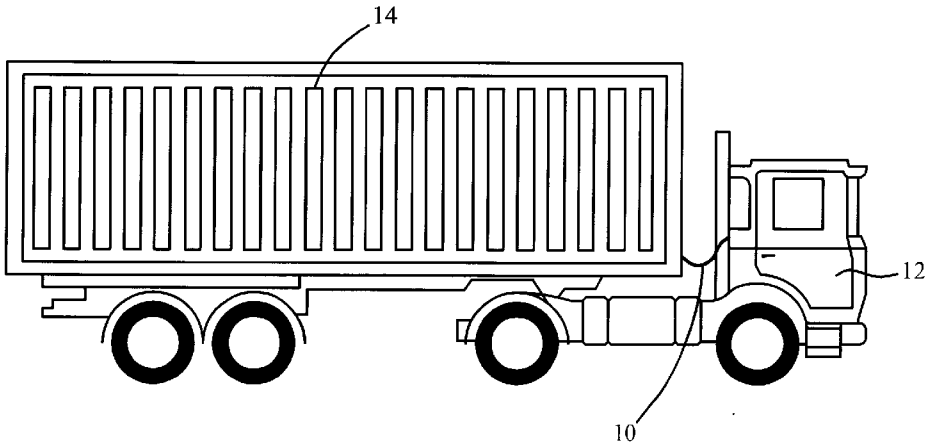
FIG. 1 is a side view of a typical truck and trailer arrangement showing a use of the electrical connector of the present invention.
Figure 2:
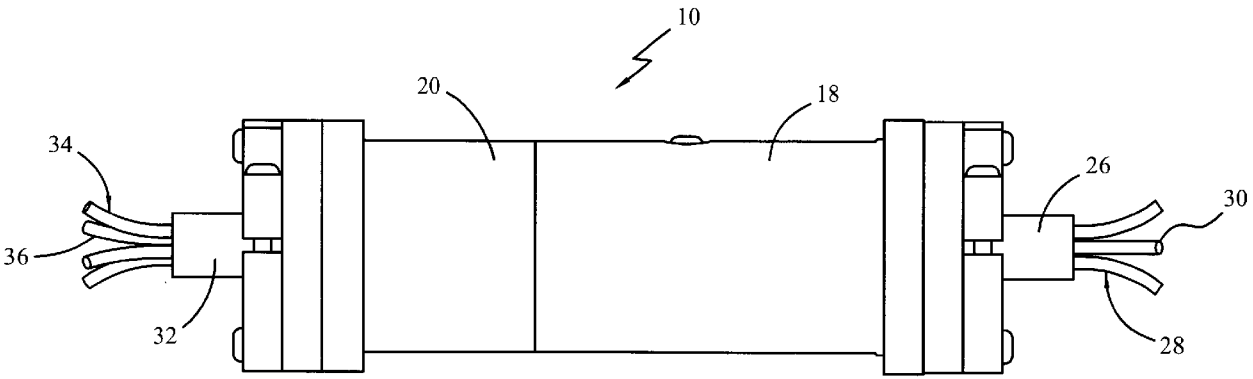
FIG. 2 is a side view of the electrical connector of the present invention shown in a connected condition.

With reference to the figures where like elements have been given like numerical designations to facilitate the reader's understanding of the present invention, and particularly with reference to the embodiments of the present invention illustrated in the attached figures, the preferred embodiments of the present invention are set forth below. In the preferred embodiments of the present invention, shown in FIGS. 1 through 14, the electrical connector, designated generally as 10, can be used in conjunction with a towing vehicle, such as truck 12, and a towed vehicle, such as trailer 14 having container 16 for transporting goods. Naturally, the invention is not so limited, as the electrical connector 10 can be used to electrically connect numerous other types of vehicles and to electrically connect other objects. The preferred embodiment of the present invention 10, as shown in FIG. 2, generally comprises a receptacle member 18 and a corresponding plug member 20. As explained in more detail below, receptacle member 18 is sized and configured to receive a portion of plug member 20 into receptacle member 18 so as to connect the electrical system of the towing vehicle 12 to the electrical components of the towed vehicle, including the tail and brake lights, any running lights and others. In one configuration, first wire assembly 22 connects the receptacle member 18 to the electrical system of the towing vehicle 12 (i.e., the truck or automobile) and second wire assembly 24 connects the plug member 20 to the towed vehicle (i.e., the trailer) 14. If desired, the receptacle member 18 can be mounted on an outer wall of the towing vehicle 12 such that the first wire assembly is inside the body of the vehicle 12. In this configuration, second wire assembly 24, having plug member 20 on one end thereof, can extend from the towed vehicle 14 to the receptacle member 18 in the towing vehicle 12, where the plug member 20 is received into receptacle member 18 to complete the electrical connection between the two vehicles 12 and 14. As is well known to those skilled in the art, the locations of receptacle member 18 and plug member 20 can be reversed, that is the plug member 20 can be attached to or mounted into the towing vehicle 12 and the receptacle member 18 can be attached to or mounted in the towed vehicle 14. In addition, both the receptacle member 18 and the plug member 20 can extend from their respective vehicle (either the towing vehicle 12 or the towed vehicle 14) and connect in the space between the two vehicles 12 and 14. Other configurations and combinations for electrical connector 10 may also be possible.

First wire assembly 22 has a first set of wires 26 comprising one or more individual wires 28 bound inside an outer wire cover or sheath 30 to protect the wires 28 inside first wire assembly 22. Second wire assembly 24 has a second set of wires 32 comprising one or more individual wires 34 bound inside an outer wire cover or sheath 36 to protect the wires 34 inside second wire assembly 24. The various configurations and components suitable for forming first 22 and second 24 wire assemblies are well known within the art. For instance, outer wire covers 30 and 36 can be formed from rubber, plastic or a variety of other materials that are suitable for protecting wires 28 and 34 inside assemblies 22 and 24. In general, wire assemblies 22 and 24 should be flexible and suitable for exposure to sun, rain and other weather-related elements. If desired, either or both first 22 and second 24 wire assembly can be enclosed in a hard outer covering (i.e., conduit) made out of metal, fiberglass, composite or other suitably hard materials that can provide increased protection to wire assemblies 22 and 24. As is also known in the art, wires 28 and 34 should be sufficiently insulated from each other to prevent an electrical short or other electrical problems. In the preferred embodiment, the number of wires 28 inside first wire assembly 22 will be equal to the number of wires 34 inside second wire assembly 24. Generally, the number of wires 28 and 34 will reflect the needs of the electrical systems to properly operate the towed vehicle 14 in conjunction with the towing vehicle 12. In some circumstances, it may be possible that it is beneficial if the number of wires are not equal.

Figure 3:
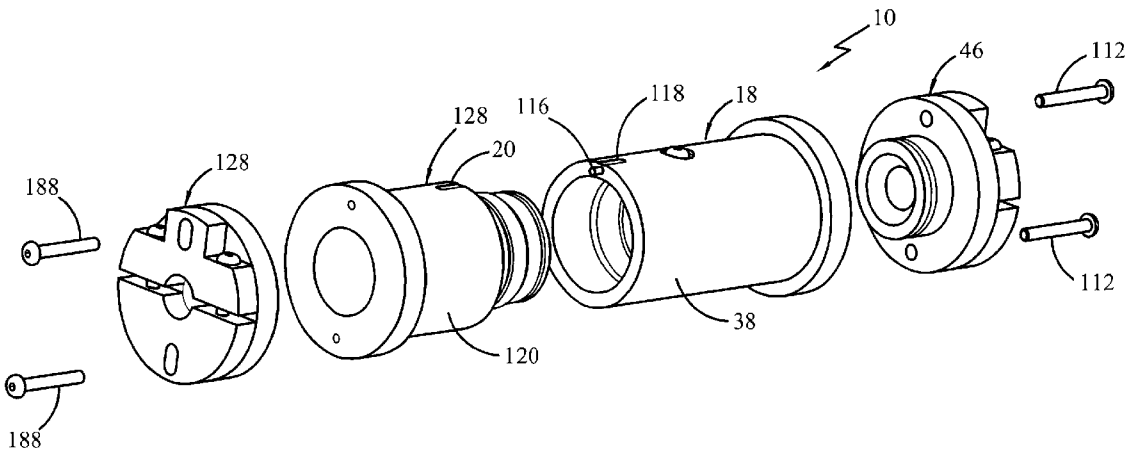
FIG. 3 is a side view of the receptacle member and plug member of a preferred embodiment of the present invention.
Figure 5:
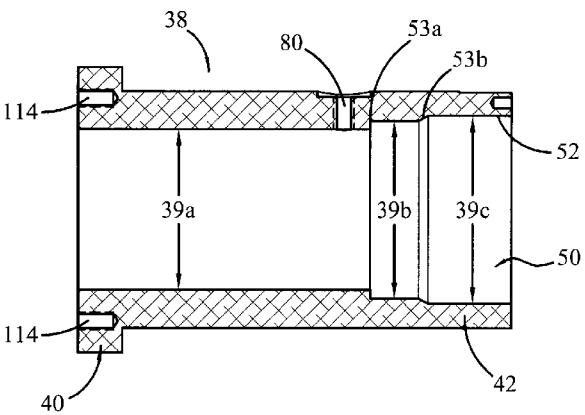
FIG. 5 is a cut-away side view of the receptacle body of the present invention.
Figure 4:
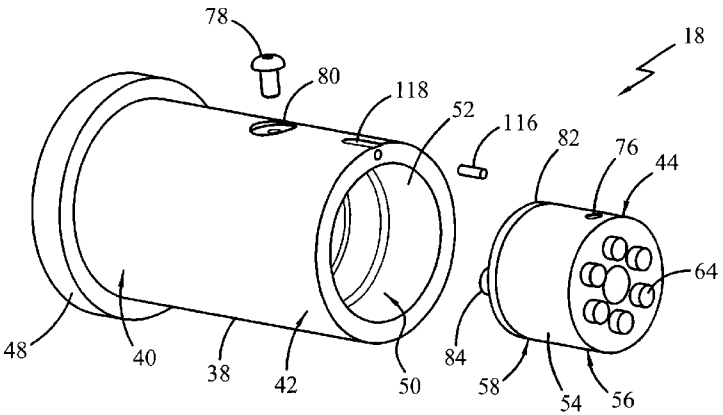
FIG. 4 is a perspective view of the receptacle body and first contact assembly of a preferred embodiment of the present invention.

In a preferred configuration, best shown in FIGS. 3 through 9, receptacle member 18 is made up of a housing 38 having first end 40 and second end 42, first contact assembly 44 and first end cap assembly 46. The housing 38 can have an enlarged portion 48 located at the first end 40 of housing 38 for receiving first end cap assembly 46, as explained in more detail below. Located at the second end 42 of housing 38 is a bore 50 for receiving plug member 20. As is best shown in FIGS. 4 and 5, bore 50 has interior side Walls 52 forming a predetermined inner diameter that is sized and configured to receive first contact assembly 44 therein and to sealably receive plug member 20 so as to form the completed electrical connector 10. In the preferred embodiment, as shown in FIG. 5, the interior diameter of housing 38 reduces from a first inner diameter 39*a* toward the first end 40 to a second 39*b* and third 39*c* inner diameter toward the second end 42 of housing 38. As explained in more detail below, the first contact assembly 44 can be positioned in the area of the first inner diameter 39*a* and various sealing mechanisms (i.e., O-rings) on plug member 20 can seal against the shoulders 53*a* and 53*b* at the interface of the first 39*a* and second 39*b* inner diameters and the second 39*b* and third 39*c* inner diameters, respectively. Also in the preferred embodiment, housing 38 is made out of an anodized aluminum material, such as aluminum 6061, that can be cast or otherwise formed into the desired shape. Other materials, including other metals, fiberglass, composites, plastics and the like would also be suitable for housing 38. Depending on the planned use of electrical connector 10, housing 38 should be made out of a material that has sufficient rigidity strength to connect to plug member 20, is generally corrosion resistant for outdoor or other uses and is not easily damaged or dislodged by exterior contact (i.e., banging against the side of vehicle 12 or trailer 14) during use or installation.

Figure 7:
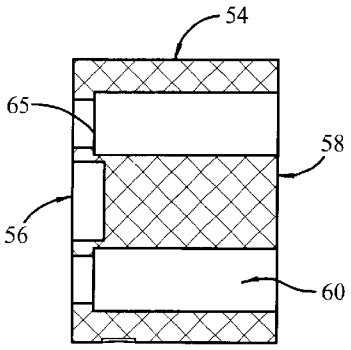
FIG. 7 is cut-away side view of the base of the first contact assembly of a preferred embodiment of the present invention.
Figure 6:
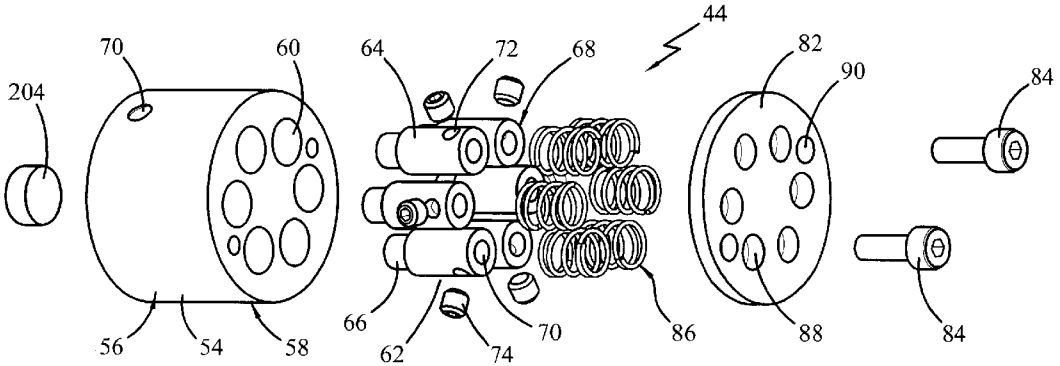
FIG. 6 is an exploded view of a preferred embodiment of the first contact assembly of the present invention.
Figure 9:
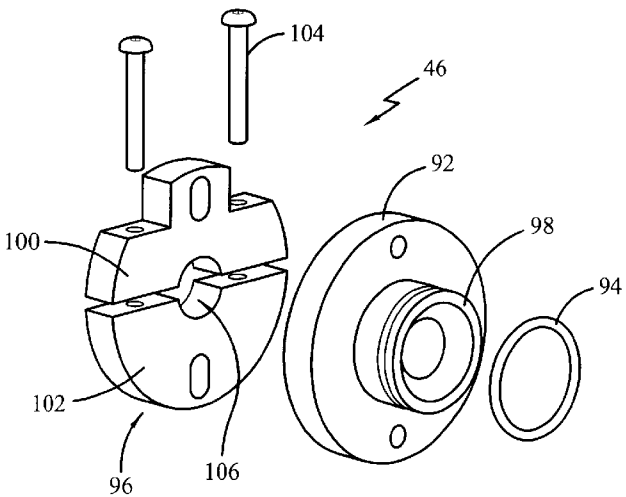
FIG. 9 is an exploded view of the first end cap assembly of the present invention.
Figure 8:
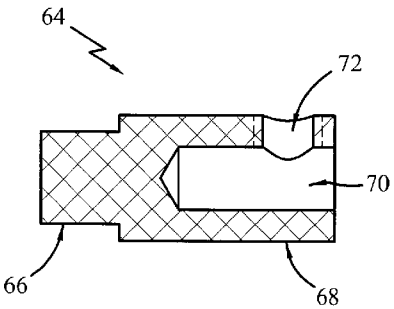
FIG. 8 is a pin for use in a preferred embodiment of the first contact assembly of the present invention.

As best shown in FIGS. 6 and 7, first contact assembly 44 has a base 54 having a forward end 56 and a rearward end 58, relative to plug member 20. Base 54 has one or more channels 60 that are sized and configured to accept a first set of pins 62 comprised of one or more pins 64, with one pin 64 being received in a single channel 60. Channels 60 and pins 64 should be configured such that one pin 64 is slidably received in one channel 60. Channels 64 can also be configured to have a narrower inner diameter at the forward end 56 of base such that pins 64 abut against the shoulder 65 at the interface where the inner diameter is reduced, as shown in FIG. 7. In the preferred embodiment, base 54 is made out of plastic and pins 64 are made out of copper. One function of base 54, and the channels 60 located therein, is to isolate the individual pins 64 from each other to prevent electrical short or arcing. Other non-conductive materials can be used for base 54, such as fiberglass, composites, rubber and other such materials. If base 54 is made from an electrically conductive material, it will have to be coated or covered to prevent electrical connection between the pins 64 and housing 38. In contrast, pins 64 need to be made from a material that is conductive so electrical current can pass from the towing vehicle 12 to the towed vehicle 14. Each of the pins 64 have a forward end 66, a rearward end 68, a bore 70 at rearward end 68 and an attachment mechanism, such as hole 72 and set screw 74. A pin 64 is received into channel 60 such that the forward end 66 of pin 64 extends beyond the forward end 56 of base 54. As best shown in FIGS. 6 and 8, the forward end 66 of pin 64 can be made to be smaller (i.e., have a reduced diameter) than the rearward end 68 of pin 64 so that only the smaller forward end 66 protrudes past the forward end 56 of base 54. As explained in more detail below, pin 64 slides back and forth inside channel 60. Bore 70 in the rearward end 68 of pin 64 is sized and configured to accept one of the wires 28 from the first set of wires 26. Wire 28 is inserted into bore 70 and then secured with the attachment mechanism, such as the placement of set screw 74 into hole 72. As is known in the art, various other mechanisms can be used to secure wire 28 to pin 64. For instance, wire 28 can be welded, clamped, bound, glued or otherwise secured inside bore 70 or the wire 28 can be welded, clamped, bound, screwed, glued or otherwise attached to the pin (i.e., at the rearward end 68 thereof). Base 54 can also contain hole 76 on the side thereof for receiving screw 78, which goes through hole 80 on the side of housing 38 (as shown in FIGS. 4 and 5), so that first contact assembly 44 can be secured inside housing 38. As is also known in the art, depending on the materials used, first contact assembly 44 may be clamped, glued, welded or otherwise secured inside housing 38 so that it does not move relative to housing 38 during use.

The rearward end 58 of base 54 of the preferred embodiment comprises a retaining plate 82 for retaining pins 64 in the channels 60 of base 54 during use of electrical connector 10. As set forth below, during use the plug member 20 pushes against the forward end 66 of pins 64, causing pins 64 to slide backward in channels 60 against retaining plate 82. As shown in FIG. 6, retaining plate 82 is attached to the rearward end 58 of base 54 by one or more cap screws 84 or the like. As is known in the art, depending on the materials used for first contact assembly 44, retaining plate 82 can be attached to the, rearward end 58 of base 54 using screws, adhesives, welding or other known mechanisms of attaching retaining plate 82 to base 54. Disposed in the first contact assembly 44 of the preferred embodiment between the retaining plate 82 and pins 64 are one or more springs 86 to bias pins 64 forward towards plug member 20 during use. As explained below, springs 86 maintain a more secure electrical connection even when electrical connector 10 is subject to vibration forces as vehicles 12 and 14 move down the road. Retaining plate 82 has one or more openings 88 therein that are spaced and configured to hold springs 86 in place yet allow wires 28 to pass through retaining plate 82 to the first set of pins 62. In the embodiment shown in FIG. 6, retaining plate 82 also has holes 90 for cap screws 84 to pass through and connect to base 54. First contact assembly 44 of the preferred embodiment, shown best as a completed unit in FIG. 4, is formed by attaching retaining plate 82 to base 54 with the pins 64 slidably disposed in channels 60 and the springs 86 disposes between the rearward end 68 of pins 64 and retaining plate 82. Other configurations for first contact assembly 44 are also possible. For instance, first contact assembly 44 can be made with the base 54 and retaining plate 82 as an integral unit.

Located at the first end 40 of housing 38 is first end cap assembly 46 for sealing the otherwise open first end 40 and providing a cord-pull mechanism for first wire assembly 22 so that a pull on the first wire assembly 22 will not disengage the wires 28 from the first contact assembly 44. As is known, it is important to keep water, dust and other contaminants out of the inside of housing 38 so as to prevent malfunction of electrical connector 10. As it is also known, the wire assembly 22 should be connected to the housing 38 so as to prevent easy disengagement of the wires 28 when the wire assembly 22 is tugged or pulled on (i.e., such as may happen when unplugging connector 10). In a preferred embodiment, shown in FIG. 9, first end cap assembly 46 comprises first end cap 92, sealing mechanism 94 and clamp assembly 96. First end cap 92 has an insert portion 98 that is inserted into the open first end 40 of housing 38. Sealing mechanism 94, such as the O-ring shown in FIG. 9, can be located on the insert portion 98 so as to seal against the inside of housing 38. Clamp assembly 96 can comprise a upper clamp 100 and a lower clamp 102 that can be clamped together by screws 104 to tightly clamp first wire assembly 22 in the opening 106 formed in clamp assembly 96. Holes 108 and 110 in first end cap 92 and clamp assembly 96, respectively, can be utilized to attach first end cap assembly 46 to the first end 40 of housing 38 using screws 112 (shown in FIG. 3). In one configuration, end cap 92 and clamp assembly 96 can be made out of anodized aluminum or other materials (i.e., like those used for housing 38). The aforementioned configuration for first end cap assembly 46 is one of several that can be utilized to cap the first end of housing 38 and provide a pull mechanism that prevents wires 28 from becoming disconnected when first wire assembly 22 is pulled on. For instance, the clamping assembly 96 can be incorporated into and be integral with end cap 92. Sealing mechanism 94 can be something other than the O-ring, such as utilizing a metal-to-metal or other material seal.

In one embodiment, receptacle member 18 is manufactured by first forming the first contact assembly 44, inserting it into the bore 50 at the second end 42 of housing 38 and then securely attaching the first end cap assembly 46 to the first end 40 of housing 38. For the embodiment shown in the attached figures, first wire assembly 22 is inserted through end cap 92 and into the first end 40 of housing 38. First contact assembly 44 is then formed by stripping off the insulation at the end of wires 28 of first wire assembly 22 and inserting the bare ends through the retaining plate 82 and springs 86 and then into bore 70 at the rearward end 68 of pin 64. Set screw 74 can be used to secure one wire 28 to one of the pins 64. Once all the wires 28 are secured to pins 64, the pins 64 are placed into channels 60 and retaining plate 82 is secured to the rearward end 58 of base 54 using cap screws 84 or other suitable attachment mechanisms. First contact assembly 44 is inserted into bore 50 until the hole 76 on base 54 is aligned with the hole 80 in housing 38 and then screw 78 is used to secure first contact assembly 44 in place. First end cap assembly 46 is attached to first end 40 of housing 38 by inserting screws 112 through the upper 100 and lower 102 clamps and end cap 92 and into the holes 114 (as shown in FIG. 5) in enlarged portion 48 of housing 38. Prior to clamping the clamp assembly 96 with screws 104, some of the excess wire 28 is pulled from inside housing 38. Some of the excess wire 28 should remain in housing 38 between the retaining plate 82 and the insert portion 98 of end cap 92 in a coiled or coil-like fashion to allow for movement of pins 94 in channels 80. To assist with engaging the plug member 20, receptacle member can include a dowel 116 in the wall of housing 38 at the second end 42, as shown in FIGS. 3 and 4. As shown, housing 38 can also have a indent mark 118 at the second end 42 to use as an alignment mechanism for plug member 20.

Figure 10:
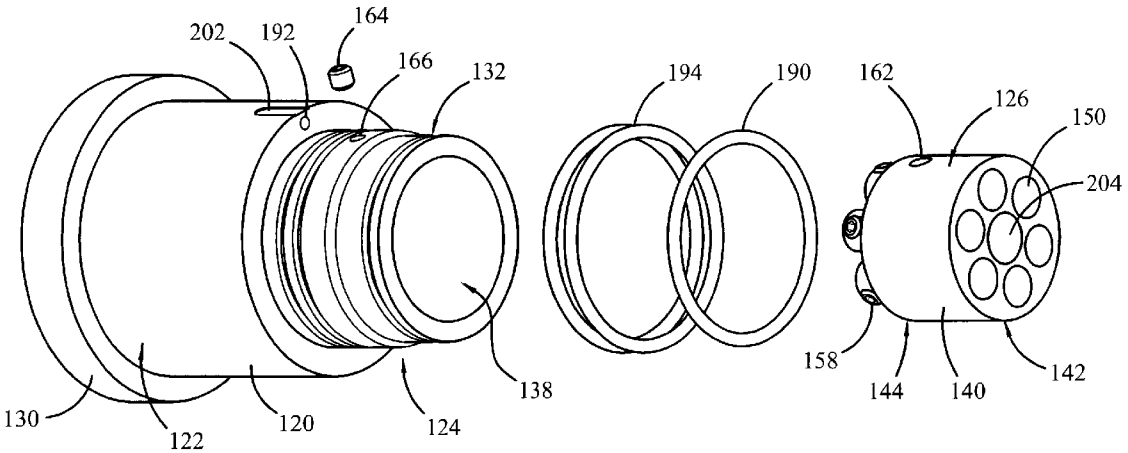
FIG. 10 is an exploded view of a preferred embodiment of the plug assembly of the present invention.
Figure 11:
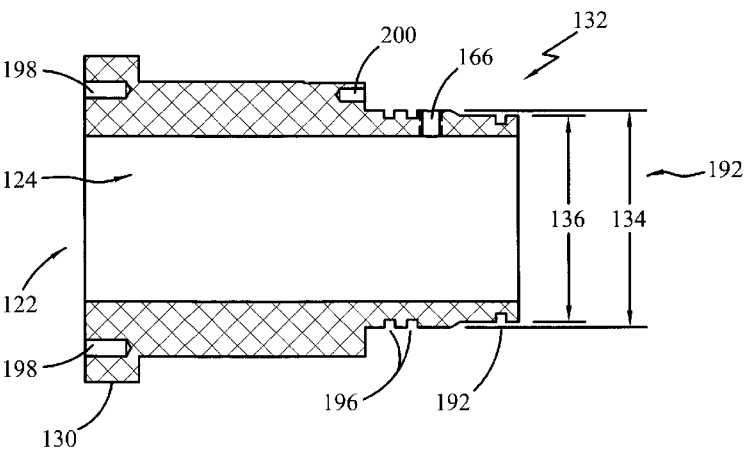
FIG. 11 is a cut-away side view of the plug housing of a preferred embodiment of the present invention.
Figure 14:
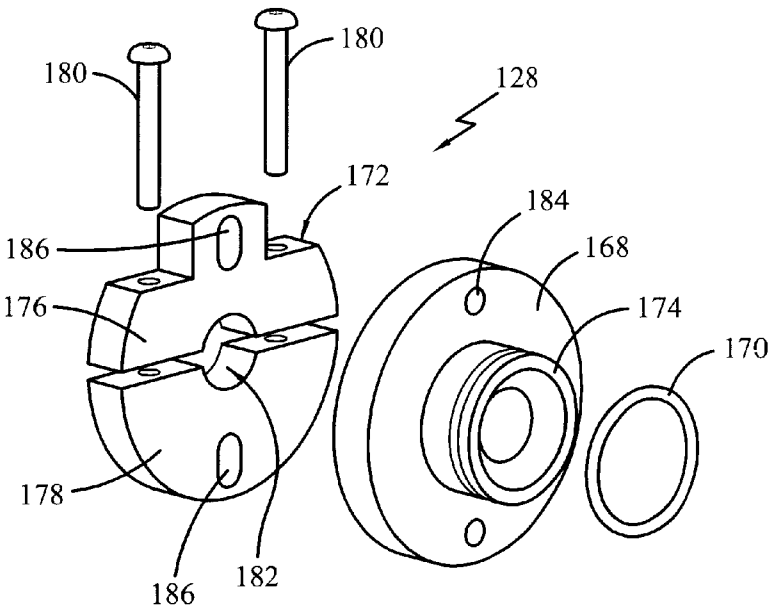
FIG. 14 is an exploded view of the second end cap assembly of the present invention.

In a preferred configuration, best shown in FIGS. 10 through 14, plug member 20 is made up of a housing 120 having first end 122 and second end 124, second contact assembly 126 and second end cap assembly 128. Housing 120 can have an enlarged section 130 located at the first end 122 of housing 120 for receiving second end cap assembly 128. Located at the second end 124 of housing 120 is a plug insert 132 sized and configured to be sealably received by bore 50 in receptacle member 18. In the preferred embodiment, as best shown in FIG. 11, the outer diameter of plug insert 132 reduces from a first outer diameter 134 to a second outer diameter 136 toward the second end 124 of housing 120. As explained in more detail below, various sealing mechanisms (i.e., O-rings) can be used on plug insert 132 to seal against the shoulders 53*a* and 53*b* in bore 50 of receptacle 18. Second end 124 of plug member 20 also comprises bore 138 for receiving second contact assembly 126. In the preferred embodiment, housing 120 is made out of an anodized aluminum material, such as aluminum 6061, that can be cast or otherwise formed into the desired shape. As with receptacle 18, other materials, including other metals, fiberglass, composites, plastics and the like would also be suitable for housing 120. The materials should also provide sufficient rigidity strength to connect to receptacle member 18, be generally corrosion resistant and not easily damaged by exterior contact (i.e., banging against the side of vehicle 12 or trailer 14) during use or installation.

Figure 12:
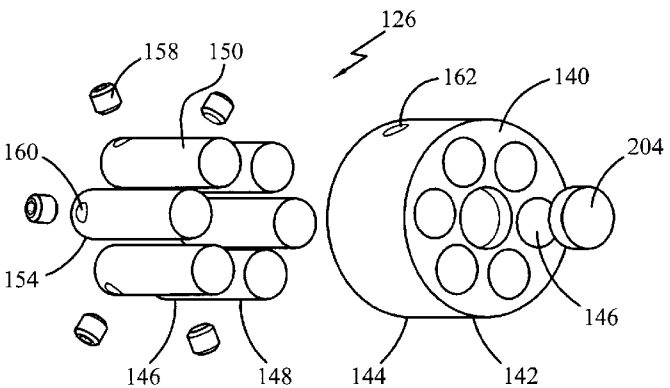
FIG. 12 is an exploded view of the second contact assembly of a preferred embodiment of the present invention.

As best shown in FIGS. 10 and 12, second contact assembly 126 has a base 140 having a forward end 142 and a rearward end 144, relative to receptacle member 18. Base 140 has one or more channels 146 that are sized and configured to accept a second set of pins 148 comprised of one or more pins 150. Channels 146 and pins 150 are configured such that one pin 150 is received in one channel 146. Channels 146 should be configured to tightly receive pins 150. In the. preferred embodiment, base 140 is made out of plastic and pins 150 are made out of copper. As with the first contact assembly 44, one function of base 140 and channels 146 is to isolate the individual pins 150 from each other to prevent electrical short or arcing. Other non-conductive materials can be used for base 140, such as fiberglass, composites, rubber and other such materials. If base 140 is made from an electrically conductive material, it will have to be coated or covered to prevent electrical connection between pins 150 and housing 120. In contrast, pins 150 need to be made from a material that is conductive so electrical current can pass from the towing vehicle 12 to the towed vehicle 14 through electrical conductor 10.

Figure 13:
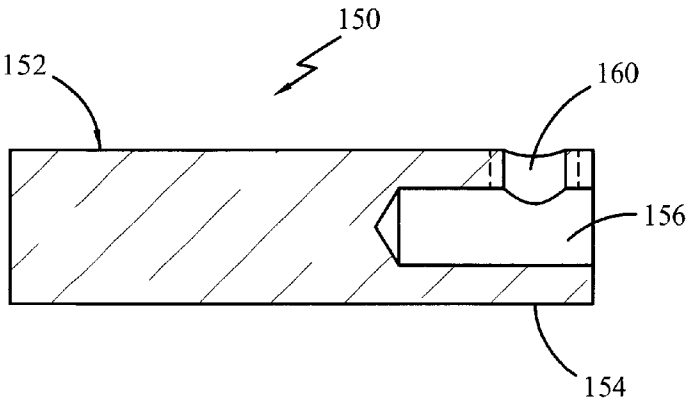
FIG. 13 is cut-away side view of a pin of the second contact assembly of the present invention.

Each of the pins 150 have a forward end 152, a rearward end 154, a bore 156 at the rearward end 154 and an attachment mechanism, such as hole 156 and set screw 158, as shown in FIGS. 12 and 13. In the preferred embodiment, pin 150 is received into channel 146 such that the forward end 152 of pin 150 is substantially flush with the forward end 142 of base 140, as best shown in FIG. 10. Bore 156 in the rearward end 154 of pin 150 is sized and configured to accept one of the wires 34 from the second set of wires 32. Wire 34 is inserted into bore 156 and then secured with the attachment mechanism, such as the placement of set screw 158 into hole 160. Wire 34 can be welded, clamped, bound, glued or otherwise secured inside bore 156 or the wire 34 can be welded, clamped, bound, screwed, glued or otherwise attached to pin 150 (i.e., at the rearward end 154 thereof). Base 140 can also contain hole 162 on the side thereof for receiving set screw 164, which goes through hole 166 on the side of plug insert 132 (as shown in FIG. 10), so that second contact assembly 126 can be secured inside plug housing 120. As is also known in the art, depending on the materials used, second contact assembly 126 may be clamped, glued, welded or otherwise secured inside housing 120 so that it does not move relative to housing 120 during use.

Located at the first end 122 of housing 120 is second end cap assembly 128 for sealing the otherwise open first end 122 and providing a cordpull mechanism for second wire assembly 24 so that a pull on the wire assembly 124 will not disengage the wires 34 from the second contact assembly 126. As is known, it is important to keep water, dust and other contaminants out of the inside of housing 120 so as to prevent malfunction of electrical connector 10. As it is also known, second wire assembly 24 should be connected to the housing 120 so as to prevent disengagement of wires 34 when wire assembly 24 is tugged or pulled on (i.e., such as may happen when unplugging connector 10). In a preferred embodiment, shown in FIG. 14, second end cap assembly 128 comprises second end cap 168, sealing mechanism 170 and clamp assembly 172. Second end cap 168 has an insert portion 174 that can be inserted into the open first end 122 of housing 120. Sealing mechanism 170, such as the O-ring shown in FIG. 14, can be located on the insert portion 174 so as to seal against the inside of housing 120. As with the receptacle member 18, clamp assembly 172 of the plug member 20 can comprise a upper clamp 176 and lower clamp 178 that can be clamped together by screws 180 to tightly clamp second wire assembly 24 in the opening 182 formed in clamp assembly 172. Holes 184 and 186 in second end cap 168 and clamp assembly 172, respectively, can be utilized to attach second end cap assembly 128 to the first end 122 of plug housing 120 using screws 188 (shown in FIG. 3). In one configuration, end cap 184 and clamp assembly 172 can be made out of anodized aluminum or various other materials (i.e., like those used for housing 120). As with the receptacle portion 18, the aforementioned second end cap assembly 128 is one of several that can be utilized to cap the first end 122 of housing 120 and provide a pull mechanism that prevents wires 34 from becoming disconnected when second wire assembly 24 is pulled on. For instance, the clamping assembly 172 can be incorporated into and be integral with end cap 168. Sealing mechanism 170 can be something other than the O-ring, such as utilizing a metal-to-metal or other material seal.

To obtain an effective seal between plug member 20 and receptacle member 18, the preferred embodiment utilizes a series of sealing mechanisms on the plug insert portion 132. In the preferred embodiment, as shown in FIGS. 10 and 11, plug insert 132 has two sets of sealing mechanisms, a first sealing mechanism 190 that is positioned in a first groove 192 nearest the second end 124 of plug housing 120 in the first outer diameter 134 section and a second sealing mechanism 194 in the second grooves 196 (in the configuration shown in the accompanying figures, two are used) set back from the second end 124 in the second outer diameter 136 section of the plug insert 132. Placing the first sealing mechanism 190 in the smaller first outer diameter 134 section of the plug insert 132 helps prevent it from being damaged as the plug member 20 is repeatedly. placed into and removed from receptacle member 18. First sealing mechanism 190 mates up against second inner diameter 39*b* and second sealing mechanism 194 mates up against third inner diameter 39*c* of the bore 50 of receptacle housing 38. The length of the interior side wall having second inner diameter 39*b* should be sufficiently long so that the arcing, if any, will cease prior to first sealing mechanism 190 passing by the area of the third inner diameter 39*c*. In this manner, any arcing that takes place due to the separation of the pins 64 in receptacle member 18 and pins 150 in plug member 20, will occur while first sealing mechanism 190 is still sealed against second inner diameter 39*b* inside bore 50. As a result of containing any arcing inside a sealed area, the electrical connector 10 of the present invention is explosion proof.

In one embodiment, plug member 20 is manufactured by first forming the second contact assembly 126, inserting it into the bore 138 at the second end 124 of housing 120 and then securely attaching the second end cap assembly 128 to the first end 122 of housing 120. For the embodiment shown in the attached figures, second wire assembly 24 is inserted through end cap 168 and into the first end 122 of housing 120. Second contact assembly 126 is then formed by stripping off the insulation at the end of the wires 34 of second wire assembly 24 and inserting the bare ends into bore 156 at the rearward end 154 of pin 150. Set screw 158 can be used to secure one wire 34 to one of the pins 150. Once all the wires 34 are secured to pins 150, pins 150 are placed into the channels 146 such that the forward end 152 of the pins 150 is substantially flush with the first end 142 of base 140. Second contact assembly 126 is inserted into bore 138 until the hole 162 on base 140 is aligned with the hole 166 in the plug insert portion 132 of housing 120. Set screw 164 is used to secure second contact assembly 126 in place. Second end cap assembly 128 is attached to first end 122 of housing 120 by inserting screws 188 through the upper 176 and lower 178 clamps and end cap 168 and into the holes 198 (as shown in FIG. 11) in enlarged section 130 of housing 120. Prior to clamping the clamp assembly 172 with screws 180, the excess wire 34 is pulled from inside housing 120. To assist with engaging the receptacle member 18, plug member 20 can include a hole 200 for receiving dowel 116 in the wall of housing 120 at the second end 122, as shown in FIGS. 3 and 4. As shown, housing 120 can also have a indent mark 202 to use as an alignment mechanism for receptacle member 18.

The preferred embodiment also utilizes one or more magnets 204, as best shown in FIG. 15, on either or both the forward ends 56 and 142 of receptacle base 54 and plug base 140. The embodiment shown in FIG. 15 utilizes magnets 204 on both ends 56 and 142 that are configured to attract each other. A variety of magnets, including rare earth magnets, can be utilized in connector 10. Alternatively, one of the magnets 204 could be replaced by magnetically attractive material that engages magnet 204 on the opposite facing end 56 or 142. The use of magnets 204 is preferred over the use of a positive physical lock between the plug member 20 and receptacle member 18 because the magnetic attraction has the advantage of allowing a less tight fit between the first 190 and second 194 sealing mechanisms on the plug member 20 and the interior of bore 50 of the receptacle member 18. This will make it easier for the user to pull apart the receptacle 18 and plug 20 members, particularly in cold weather when a tight fit could be very difficult to pull apart. The less tight fit also has the advantage of being less likely to be damaged if the plug member 20 is suddenly pulled out of receptacle member 18 (i.e., when the user forgets to unlock the connector 10 when pulling the vehicles apart). In addition, use of magnets 204 will provide a snap-together fit when joining receptacle member 18 and plug member 20.

In use, electrical connector 10 can be used to electrically connect a variety of objects together, including a towed vehicle 14 to a towing vehicle 12, as described in the example above. Generally, an electrical connector 10 according to the present invention would be configured for a specific type of use where the number of wires needed for first 22 and second 24 wire assemblies are known due to being standard for the particular use. In fact, it may be preferred to build either the receptacle member 18 or plug member 20 directly into the object that will be electrically connected. For instance, receptacle member 18 manufactured according the above description, could be built into the trailer hitch assembly located on the towing vehicle 12. When not in use, a blank plug (not shown) could be placed inside the bore 50 of receptacle member 18 to prevent unwanted contact with the electrically "hot" pins 64. The trailer 14 could have a second wire assembly 24 extending from the trailer 14 with a plug member 20 on the end thereof that can be plugged into the receptacle member 18 when an electrical connection between the two vehicles is desired. The trailer or other towed object 14 can be equipped with a blank receptacle or similar opening (not shown) for receiving plug member 20 when the electrical connection is not needed or desired to protect the flush face end of plug member 20 from damage. Although it is possible to switch the locations of receptacle member 18 and plug member 20, safety concerns with regard to having electrically hot pins 150 on the flush face of plug member 20 must first be addressed by providing a mechanism to cover the plug member 20 or shut off the electrical power to the pins 150.

The sealing mechanisms 190 and 194 on the plug insert 132 and the sealing mechanisms 94 and 170 at the cap ends of receptacle member 18 and plug member 20, respectively, keep water, moisture, dust and other contaminants out of the electrical connector 10 during use. Use of O-rings or like sealing members as the sealing mechanisms for the present invention 10 has the advantage of also providing (in addition to their sealing function) a damper mechanism for damping the vibration forces resulting from the vehicles moving down the road. This will help prevent the electrical connector 10 from becoming unsealed during use as a result of the vibration forces. To make it easier for plug insert 132 on plug member 20 to be received by bore 50 of receptacle member 18, a small hole can be located in and through the wall of housing 38 of receptacle member near the location of the pins 50 on first contact assembly 44. The first sealing mechanism 190, near the second end 124 of plug insert 132, can be sized and configured to seal this small hole when the plug member 20 is in place against receptacle member 18. As plug insert 132 enters bore 50, air that would otherwise be compressed between the first contact assembly 44 and the second contact assembly 126 will be able to escape through this small hole, thereby reducing the resistance and force necessary to accomplish the mating of plug member 20 into receptacle member 18.

In another alternative embodiment, the electrical connector 10 can utilize flexible wires between the first contact assembly 44 and the first end cap assembly 46 in the receptacle member 18. As discussed above, it is necessary that the wires between the contact assembly 44 and end cap assembly 46 be coiled or otherwise placed in a coil-like condition to allow pins 64 to "float" in the base 54 without disconnecting from the wires 28. However, some wire assemblies have wires that are too thick (i.e., 10 gauge wire) to be flexible enough to provide the coil necessary to allow pins 64 to move. For such uses, a separate wire system, made up of flexible wire(s), can be incorporated between pins 64 and/or first contact assembly 44 and the first end cap assembly 46 to provide the coil action necessary to allow pins 64 to move inside channels 60 of base 54. If desired, a sheath made out of fiberglass or other materials can be used over the flexible wire(s) to insulate the wire(s) between first contact assembly 44 and first end cap assembly 46.

While there are shown and described herein certain specific alternative forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to the dimensional relationships set forth herein and modifications in assembly, materials, size, shape, and use. For instance, there are numerous components described herein that can be replaced with equivalent functioning components to accomplish the objectives of the present invention. The present invention resides in the novel features of form, construction, mode of operation and combination of elements presently described and understood by the claims.

What is claimed is:

1. An electrical connector, comprising:

a receptacle member having a housing with a first end and a second end, said second end further comprising a bore having at least a first inner diameter, a second inner diameter and a third inner diameter;

a first wire assembly connected to said electrical connector at said first end of said housing of said receptacle member, said first wire assembly having a first set of wires comprised of one or more wires;

a first contact assembly disposed in said bore, said first contact assembly having one or more first pins, each one of said first pins electrically connected to one of said wires in said first set of wires;

a plug member having a housing with a first end and a second end, said plug member further comprising an insert portion at said second end of said plug member, said insert portion configured to be releasably mateable in said bore of said receptacle member, said insert portion comprising at least two sealing mechanisms, at least one of said sealing mechanisms configured to seal said insert portion in said second inner diameter of said bore and at least one of said sealing mechanisms configured to seal said insert portion in said third inner diameter of said bore;

a second wire assembly connected to said electrical connector at said first end of said housing of said plug member, said second wire assembly having a second set of wires comprising one or more wires; and a second contact assembly in said insert portion at said first end of said plug member, said second contact assembly having one or more second pins configured to abut said first pins when said insert portion is inserted into said bore, each one of said second pins electrically connected to one of said wires in said second set of wires.

2. The electrical connector of claim 1, wherein said insert portion of said plug member comprises one or more sealing mechanisms configured to seal said insert portion in said bore of said receptacle member.

3. The electrical connector of claim 1 further comprising a second end cap assembly at said first end of said housing of said plug member, said second end cap assembly configured to seal said first end of said housing and tightly engage said second wire assembly.

4. The electrical connector of claim 1 further comprising one or more magnets on said first contact assembly.

5. The electrical connector of claim 1 further comprising one or more magnets on said second contact assembly.

6. The electrical connector of claim 1 further comprising a first end cap assembly at said first end of said housing of said receptacle member, said first end cap assembly configured to seal said first end of said housing and tightly engage said first wire assembly.

7. The electrical connector of claim 6, wherein said first end cap assembly has a clamp assembly for engaging said first wire assembly.

8. The electrical connector of claim 1, wherein said second contact assembly further comprises a base having a forward end, a rearward end and one or more channels therein, said channels configured to hold said second pins therein.

9. The electrical connector of claim 8, wherein said second pins have a forward end and a rearward end, said forward end of said second pins substantially flush with said forward end of said base.

10. The electrical connector of claim 1, wherein said first contact assembly further comprises a base having a forward end, a rearward end and one or more channels therein, said channels configured to slidably receive said first pins therein.

11. The electrical connector of claim 10, wherein said first pins have a forward end and a rearward end, said forward end of said first pins extending beyond said forward end of said base.

12. The electrical connector of claim 11 further comprising one or more springs disposed between said rearward end of said first pins and said rearward end of said base, said one or more springs configured to bias said first pins toward said forward end of said base.

13. The electrical connector of claim 12 further comprising a retaining plate at said rearward end of said base, said one or more springs disposed between said retaining plate and said rearward end of said pins.

14. An electrical connector, comprising:

a receptacle member having a housing with a first end and a second end, said second end further comprising a bore having at least a first inner diameter, a second inner diameter and a third inner diameter;

a first wire assembly connected to said electrical connector at said first end of said housing of said receptacle member, said first wire assembly having a first set of wires comprised of one or more wires;

a first contact assembly disposed in said bore, said first contact assembly having a base with a forward end, a rearward end and one or more channels in said base, each of said channels configured to slidably receive a first pin therein, each of said first pins electrically connected to one of said wires in said first set of wires;

a plug member having a housing with a first end and a second end, said plug member further comprising an insert portion at said second end of said plug member, said insert portion configured to be releasably mateable in said bore of said receptacle member, said insert portion comprising at least two sealing mechanisms, at least one of said sealing mechanisms configured to seal said insert portion in said second inner diameter of said bore and at least one of said sealing mechanisms configured to seal said insert portion in said third inner diameter of said bore;

a second wire assembly connected to said electrical connector at said first end of said housing of said plug member, said second wire assembly having a second set of wires comprising one or more wires; and a second contact assembly in said insert portion at said first end of said plug member, said second contact assembly further comprises a base having a forward end, a rearward end and one or more channels therein, each of said channels configured to hold a second pin therein, said second pins configured to abut said first pins when said insert portion is inserted into said bore, each of said second pins electrically connected to one of said wires in said second set of wires.

15. The electrical connector of claim 14 further comprising one or more springs disposed between said first pins and said rearward end of said base, said one or more springs configured to bias said first pins so as to extend beyond said forward end of said base.

16. The electrical connector of claim 14 further comprising a first end cap assembly at said first end of said housing of said receptacle member, said first end cap assembly configured to seal said first end of said housing and tightly engage said first wire assembly.

17. The electrical connector of claim 14, wherein said insert portion of said plug member comprises one or more sealing mechanisms configured to seal said insert portion in said bore of said receptacle member.

18. The electrical connector of claim 14, wherein said second pins have a forward end and a rearward end, said forward end of said second pins substantially flush with said forward end of said base.

19. The electrical connector of claim 14 further comprising a second end cap assembly at said first end of said housing of said plug member, said second end cap assembly configured to seal said first end of said housing and tightly engage said second wire assembly.

20. The electrical connector of claim 14 further comprising one or more magnets on said first contact assembly.

21. The electrical connector of claim 14 further comprising one or more magnets on said second contact assembly.

22. An electrical connector, comprising:

a receptacle member having a housing with a first end and a second end, said second end further comprising a bore having at least a first inner diameter, a second inner diameter and a third inner diameter;

a first wire assembly connected to said electrical connector at said first end of said housing of said receptacle member, said first wire assembly having a first set of wires comprised of one or more wires;

a first contact assembly disposed in said bore, said first contact assembly having a base with a forward end, a rearward end and one or more channels in said base, each of said channels configured to slidably receive a first pin therein, each of said first pins electrically connected to one of said wires in said first set of wires;

one or more springs disposed between said first pins and said rearward end of said base, said one or more springs configured to bias said first pins so as to extend beyond said forward end of said base;

a retaining plate at said rearward end of said base, said one or more springs disposed between said retaining plate and said rearward end of said pins;

a plug member having a housing with a first end and a second end, said plug member further comprising an insert portion at said second end of said plug member, said insert portion configured to be releasably mateable in said bore of said receptacle member, said insert portion of comprising at least two sealing mechanisms, at least one of said sealing mechanisms configured to seal said insert portion in said second inner diameter of said bore and at least one of said sealing mechanisms configured to seal said insert portion in said third inner diameter of said bore;

a second wire assembly connected to said electrical connector at said first end of said housing of said plug member, said second wire assembly having a second set of wires comprising one or more wires; and a second contact assembly in said insert portion at said first end of said plug member, said second contact assembly further comprises a base having a forward end, a rearward end and one or more channels therein, each of said channels configured to hold a second pin therein, said second pins configured to abut said first pins when said insert portion is inserted into said bore, each of said second pins electrically connected to one of said wires in said second set of wires.

23. The electrical connector of claim 22 further comprising a first end cap assembly at said first end of said housing of said receptacle member, said first end cap assembly configured to seal said first end of said housing and tightly engage said first wire assembly.

24. The electrical connector of claim 22 further comprising a second end cap assembly at said first end of said housing of said plug member, said second end cap assembly configured to seal said first end of said housing and tightly engage said second wire assembly.

25. The electrical connector of claim 22 further comprising one or more magnets on said first contact assembly.

26. The electrical connector of claim 22 further comprising one or more magnets on said second contact assembly.

27. An electrical connector, comprising:

a receptacle member having housing with a first end and a second end, said second end further comprising a bore having at least one inner diameter;

a first wire assembly connected to said electrical connector at said first end of said housing of said receptacle member, said first wire assembly having a first set of wires comprised of one or more wires;

a first contact assembly disposed in said bore, said first contact assembly having a base with a forward end, a rearward end and one or more channels in said base, each of said channels configured to slidably receive a first pin therein, each of said first pins having a forward end and a rearward end, said forward end of said first pins extending beyond said forward end of said base, each of said first pins electrically connected to one of said wires in said first set of wires;

one or more springs disposed between said rearward end of said first pins and said rearward end of said base, said one or more springs configured to bias said first pins toward said forward end of said base;

a retaining plate at said rearward end of said base, said one or more springs disposed between said retaining plate and said rearward end of said pins a plug member having a housing with a first end and a second end, said plug member further comprising an insert portion at said second end of said plug member, said insert portion configured to be releasably mateable in said bore of said receptacle member;

a second wire assembly connected to said electrical connector at said first end of said housing of said plug member, said second wire assembly having a second set of wires comprising one or more wires; and a second contact assembly in said insert portion at said first end of said plug member, said second contact assembly having one or more second pins configured to abut said first pins when said insert portion is inserted into said bore, each one of said second pins electrically connected to one of said wires in said second set of wires.

28. The electrical connector of claim 27, wherein said second contact assembly further comprises a base having a forward end, a rearward end and one or more channels therein, said channels configured to hold said second pins therein, said second pins having a forward end and a rearward end, said forward end of said second pins substantially flush with said forward end of said base.

29. The electrical connector of claim 27 further comprising one or more magnets on said first contact assembly.

30. The electrical connector of claim 27 further comprising one or more magnets on said second contact assembly.

31. The electrical connector of claim 27 further comprising a first end cap assembly at said first end of said housing of said receptacle member, said first end cap assembly configured to seal said first end of said housing and tightly engage said first wire assembly.

32. The electrical connector of claim 31, wherein said first end cap assembly has a clamp assembly for engaging said first wire assembly.

* * * * *